United States Patent [19]

Fishman et al.

[11] Patent Number: 4,744,407

[45] Date of Patent: May 17, 1988

[54] APPARATUS AND METHOD FOR CONTROLLING THE POUR OF MOLTEN METAL INTO MOLDS

[75] Inventors: Oleg Fishman, Dresher, Pa.; William R. Pflug, Mt. Laurel; Thomas E. Sheie, Willingboro, both of N.J.

[73] Assignee: Inductotherm Corp., Rancocas, N.J.

[21] Appl. No.: 928,769

[22] Filed: Nov. 10, 1986

Related U.S. Application Data

[63] Continuation-in-part of Ser. No. 920,401, Oct. 20, 1986, abandoned.

[51] Int. Cl.[4] ..... B22D 46/00

[52] U.S. Cl. ..... 164/457; 164/155

[58] Field of Search ..... 164/457, 155, 156

[56] References Cited

U.S. PATENT DOCUMENTS

| | | | |
|---|---|---|---|
| 2,743,492 | 5/1956 | Easton . | |
| 3,122,800 | 3/1964 | Naffziger . | |
| 3,537,505 | 11/1970 | Thalmann et al. . | |
| 3,570,449 | 3/1971 | Blecherman et al. | 118/9 |
| 3,590,777 | 7/1971 | Talboom, Jr. et al. | 118/7 |
| 3,633,010 | 1/1972 | Svetlichny | 235/151.3 |
| 3,636,360 | 1/1972 | Oishi et al. | 250/218 |
| 3,643,724 | 2/1972 | Lee . | |
| 3,730,254 | 5/1973 | Namy | 164/268 |
| 3,741,656 | 6/1973 | Shapiro | 356/103 |
| 3,834,587 | 9/1974 | Bengt et al. | 222/56 |
| 3,838,727 | 10/1974 | Levi et al. . | |
| 3,942,577 | 3/1976 | Uozumi et al. . | |
| 3,946,795 | 3/1976 | Bruderer et al. . | |
| 4,015,128 | 3/1977 | Della Vedova | 250/342 |
| 4,112,998 | 9/1978 | Sato | 164/136 |
| 4,114,675 | 9/1978 | Buhrer | 164/457 |
| 4,134,444 | 1/1979 | Fujie et al. | 164/155 |
| 4,160,168 | 7/1979 | Funck | 250/564 |
| 4,210,192 | 7/1980 | Lavanchy . | |
| 4,227,565 | 10/1980 | Lavanchy et al. | 164/155 |
| 4,247,784 | 1/1981 | Henry | 250/577 |
| 4,271,896 | 6/1981 | Becus | 164/449 |
| 4,276,921 | 7/1981 | Lemmens et al. . | |
| 4,304,287 | 12/1981 | Lavanchy et al. | 164/4.1 |
| 4,354,180 | 10/1982 | Harding | 340/619 |
| 4,453,083 | 6/1984 | Bohlander et al. | 250/561 |
| 4,620,353 | 11/1986 | Pryor | 29/407 |
| 4,651,800 | 3/1987 | Kollberg | 164/150 |
| 4,673,025 | 6/1987 | Mortimer | 164/457 |

FOREIGN PATENT DOCUMENTS

| | | | |
|---|---|---|---|
| 206950 | 2/1984 | German Democratic Rep. | 164/457 |
| 53-51138 | 5/1978 | Japan | 164/457 |
| 58-110169 | 6/1983 | Japan | 164/457 |
| 984668 | 1/1983 | U.S.S.R. | 164/457 |

*Primary Examiner*—Kuang Y. Lin

*Attorney, Agent, or Firm*—Seidel, Gonda, Goldhammer & Abbott

[57] ABSTRACT

An apparatus and method for controlling the pour of molten metal into individuals molds. The apparatus comprises a reservoir for holding molten metal to be poured into at least one mold having a sprue and a mold gating system, and a flow control device operatively associated with the reservoir for controlling the flow of molten metal from the reservoir into the mold. A sensor continuously senses the image of the surface of the molten metal in the mold and generates image area information representative of the surface area of the metal relative to the surface of the mold. A sampling circuit repetitively samples the image area information during a pour and generates sampled image area information at a preselected sampling rate. A comparator repetitively compares the sampled image area information to a preselected reference area value and generates a difference value representative of the difference between the image area information and the reference area value. Control apparatus responsive to the difference value generates a control signal to the flow control device for controlling the flow of molten metal to minimize the difference.

22 Claims, 3 Drawing Sheets

APPARATUS AND METHOD FOR CONTROLLING THE POUR OF MOLTEN METAL INTO MOLDS

CROSS-REFERENCE TO RELATED APPLICATION

This application is a continuation-in-part of application Ser. No. 920,401, filed Oct. 20, 1986, entitled "Apparatus And Method For Controlling The Pour Of Molten Metal Into Molds", now abandoned.

FIELD OF THE INVENTION

The present invention relates to casting of metal into molds in foundry installations, and in particular relates to an apparatus and method which accurately controls the pouring process of molten metal into the molds which allows the mold to be filled quickly, accurately and repeatably at a flow rate determined only by the internal construction of the mold and not affected by external factors.

BACKGROUND OF THE INVENTION

The quality of mold casting is affected a great deal by the process of filling the molds with molten metal. It is extremely important to quickly flood the sprue cup of the mold and maintain it full while metal propagates through the gating system of the mold into the mold cavities. This assures high quality castings without voids, misruns and gas entrapments. In addition, to prevent massive spills of molten metal, it is necessary to control the flow of the molten metal stream during the final stage of a pour (usually referred to in the prior art as "cut off") so that so-called "metal in transit" from a casting ladle or other source will just fill the mold without over-filling it.

Traditionally, this pouring operation is performed manually. Prior attempts to automate the process have not been successful. Unsuccessful attempts include tilting a lip-type ladle or opening a bottom pour ladle for a given period of time. (See U.S. Pat. Nos. 3,838,727, 3,842,894 and 4,276,921). However, these methods fall short of that desired because they lead to frequent overpours or underpours since the flow of metal is not controlled.

Another unsuccessful prior art method utilizes optical sensors which detect molten metal rising through vents in the mold. The sensors output a signal which activates a mechanism to cut off the flow. However, this method also has several drawbacks. For one thing, actual flow into the molds is not controlled as a function of the mold. Moreover, the detection of full vents, so called "pop-offs," results in over-filling the mold, since the "mold full" signal is detected too late, and the "metal in transit" to the mold cannot be accommodated by the mold. The method is also unreliable because splashes of molten metal around the sprue cup can confuse the sensor and cause premature flow cut off.

Still another method is described in U.S. Pat. No. 4,304,287. In the method described in that patent, two optical sensors are utilized. One measures the intensity of light emitted by the molten metal stream. The second measures the intensity of light emitted by the molten metal in the sprue cup. The analog outputs from these sensors are compared with reference values and, when rapid change in the signal from the light sensors is detected, indicating that the mold is nearing the full condition, the flow is cut off. This method is better than sensing full "pop-offs", but nevertheless has its disadvantages. The level of molten metal in the sprue cup is referenced to an absolute reference, the position of the sensor, and not to the surface of the mold. The system cannot accomodate for wide variations (typically $\pm\frac{1}{2}$ inch) in mold dimensions. Moreover, the flow cut off signal is generated relatively too late and may still result in spill-overs of metal in transit to the mold. In addition, slag in the sprue cup can reduce the intensity of light detected by the sensors and lead to errors in generating the flow cut off signal.

The present invention differs significantly from known methods in that it controls the flow of molten metal into the molds so that the flow rate of metal into the sprue cup is always equal to the flow of metal into the mold through the mold gating system. The flow rate is not necessarily constant. In addition, the method of the present invention can be made adaptive so that the flow of metal is controlled during the entire pour based on information obtained from previous pours, so that the flow rate is controlled while also accomodating the metal stream in transit to the mold, so that the metal in transit just fills the mold rather than overfilling it. Pour parameters can be updated after each pour, enabling the system to "learn" how to fill a new mold precisely after just a few pours.

Moreover, the present invention is not adversely affected by external factors such as changes in the viscosity of molten metal, or changes in the diameter of the metal stream. It is also independent of metal height, or "head", in the pouring ladle or other molten metal reservoir.

The present invention has several additional benefits. It provides the capability for the accurate position of the molten metal stream directly in the center of the sprue cup. And, by analyzing the pour control signal generated by the present invention, it is possible to detect abnormalities caused by a broken mold or other malfunctions in the mold filling system.

SUMMARY OF THE INVENTION

The present invention includes an apparatus for controlling the pour of molten metal into individual molds, and comprises reservoir means for holding molten metal to be poured into at least one mold and flow control means operatively associated with the reservoir means for controlling the flow of molten metal from the reservoir means into the mold. Sensor means are provided for continuously sensing the image of the surface of molten metal in the sprue cup of the mold and generating information representative of the area of the surface of the molten metal in the sprue cup relative to the surface of the mold. Means are provided for comparing the image area information to a preselected reference area value and generating a difference value representative of the difference between the image area information and the reference area value. Control means responsive to the difference value generates a control signal to the flow control means for controlling the flow of molten metal to minimize the difference.

The invention may in addition include adaptive means for generating control signal bias values which compensate for "metal in transit" over the whole duration of the pour including the final stages of the pour to prevent overfilling or under-filling of the mold. The control means is adaptive so as to "learn" historical information of pour parameters from previous pours. This aspect of the invention comprises sensor means for sensing a parameter representative of a pour characteristic and generating information representative of the sensed parameter, and means for comparing the information to a preselected reference parameter value and generating a difference value representative of the difference between the information and the reference parameter value. A control means is responsive to the difference value for generating a pour control signal, and includes adaptive means for generating control bias values over the duration of a pour based on parameter information from previous pours for adaptively altering the control signal for successive pours.

The adaptive control aspect of the invention may be utilized separately or in conjunction with image area comparison aspect of the invention.

The present invention also includes a method of controlling the pour of molten metal into individual molds, and comprises the steps of continuously sensing the area of the molten metal in the sprue cup of the mold and generating information representative of the area, comparing the area information to a preselected reference area value and generating a difference value representative of the difference between the area information and the reference area value, and controlling the flow of molten metal from a source thereof into the mold to minimize the difference.

The invention may in addition comprise adaptively controlling the flow of molten metal into the mold during the pour, especially the end of the pour, to accomodate "metal in transit" to prevent over- or under-filling of the mold. As with the apparatus, the adaptive control aspect of the method may be utilized separately or in conjunction with the image area comparison aspect of the method.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
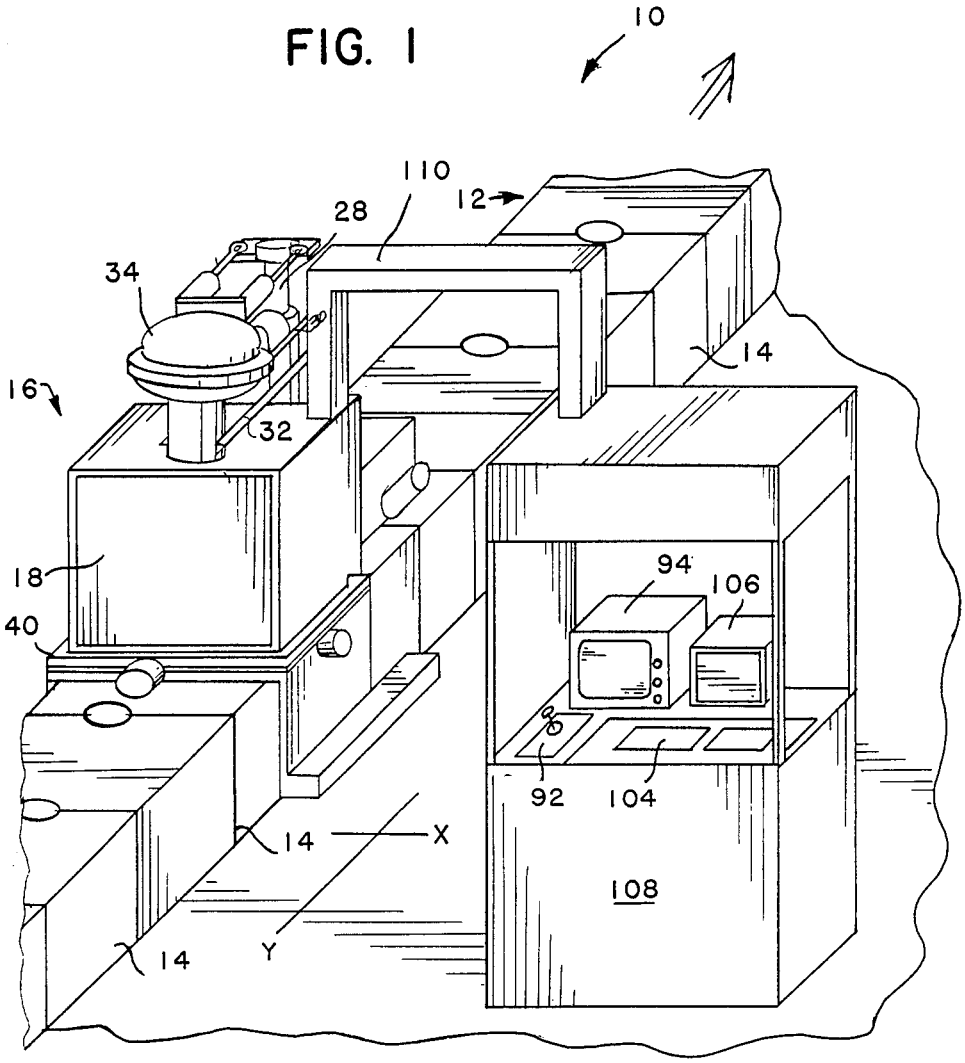
FIG. 1 is a simplified diagrammatic view of an apparatus according to the present invention as it might be implemented in a foundry or a conveyor production line.

Referring now to the drawings, wherein like numerals indicate like elements, there is shown in FIG. 1 apparatus 10 according to the present invention as it would be implemented in a foundry or on a conveyor casting line. Apparatus 10 comprises a conventional conveyor line 12 which transports a plurality of molds 14 to casting station 16 where molds 14 are filled with molten metal to be cast. As shown in FIG. 1, conveyor line 12 advances molds 14 from lower left to upper right (as viewed in FIG. 1). Conveyor 12 may be of the indexing type, which indexes one mold at a time to a filling location adjacent casting station 16. Conveyor line 12 may also be of the continuous type, on which molds are advanced at constant speed. Conveyor line 12 is well known and well understood in the art, and therefore need not be described in further detail here.

Casting station 16 comprises a molten metal reservoir 18. As seen in both FIGS. 1 and 2, reservoir 18 comprises a shell 20 and a refractory lining 22. Shell 20 and refractory lining 22 are of suitable high-temperature material to contain molten metal 24 to be cast. Reservoir 18 is provided with a pour opening 26 in its bottom surface through which molten metal is poured into a mold 14. The flow of metal through pour opening 26 to mold 14 is controlled by a stopper rod 28, which controls the pour of metal from reservoir 18 in known manner. Stopper rod 28 is operated by levers 30 and 32 driven by a pneumatic booster 34. Pneumatic booster 34 is controlled by electric-to-pneumatic transducer assembly 36 in response to electronic control signals generated in a manner to be described in greater detail hereinbelow.

Figure 2:
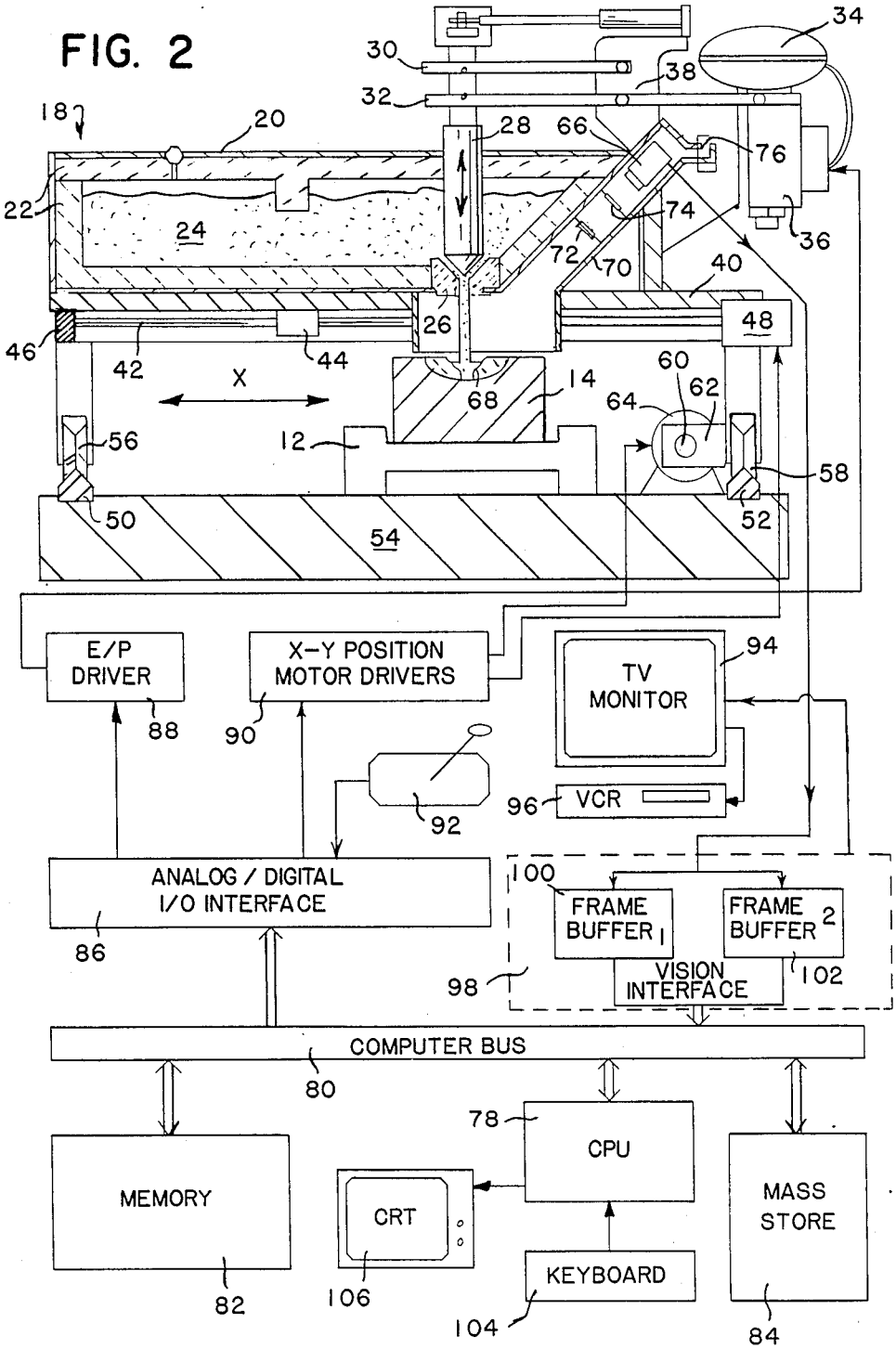
FIG. 2 is a simplified diagrammatic representation of the present invention, showing both the mechanical and electronic subsystems of the invention.

Stopper rod 28 moves vertically up and down in the direction of the double headed arrow shown in FIG. 2. Except for up and down movement, stopper rod 28 is fixed with respect to reservoir 18 so that the axis of stopper rod 28 is always coaxial with axis of pour opening 26. Pneumatic booster 34, operating levers 30, 32 and electric-to-pneumatic transducer assembly 36 are all fixed to reservoir 18 via a suitable mounting bracket 38.

Casting station 16 also comprises X-Y positioning table 40 which is capable of movement in X-Y directions. The X and Y directions are mutually orthogonal in the horizontal plane, as shown by the X and Y axes in FIG. 1. As best seen in FIG. 2, X-Y table 40 is moved in the X direction by a lead screw 42 and nut 44. Lead screw 42 is journaled at one end 46 and rotated at the other end by electric motor 48. Electric motor 48 is operated by electrical signals generated as will be described in greater detail hereinbelow. Other means for moving table 40 include linear motors, hydraulic cylinders and other suitable means.

X-Y table 40 is mounted for movement in the Y direction on co-parallel rails 50, 52 embedded in foundry floor 54. X-Y table 40 moves in the Y direction on wheels 56, 58 which ride on rails 50 and 52 respectively. X-Y table 40 is driven in the Y direction by lead screw 60 and nut 62. As with lead screw 42, lead screw 60 is journaled at one end and driven at the other end by electric motor 64. Electric motor 64 is operated by electrical signals generated as will be described in greater detail hereinbelow.

Also fixedly mounted with respect to reservoir 18 is an image sensor 66 which may be a conventional video camera which generates a continuous video signal, o.r a digital electronic camera. A digital electronic camera is preferred, although not required, and such cameras are wellknown in the art. Camera 66 is focused on the surface of mold 14 around a sprue cup 68, which may but need not be cone-shaped, to acquire a digital image of the surface of the molten metal in sprue cup 68 during a pour. Camera 66 is mounted at one end of a viewing tube 70. A quartz screen 72 and an infrared filter 74 may be provided, if desired, to protect camera 66 from excessive heat radiated by the molten metal being poured, but are not required. If desired, chilled air or inert gas, depending upon the particular metal being cast, may be introduced into tube 70 through inlet 76 to generate a positive pressure in tube 70 to prevent fumes and dust from entering tube 70 and interfering with the vision of camera 66. The exterior surfaces of tube 70 may be lined with a refractory material, if desired, to withstand the heat of the molten metal being poured.

The various electronic, monitoring, processing and control devices for the present invention, which may be referred to collectively as the electronic subsystem, are best seen in FIG. 2. The electronic subsystem is described as it would be configured when a digital electronic camera 66 is employed. However, modifications to the electronic subsystem for use with a continuous-signal video camera are believed well within the skill in the art.

At the center of the electronic subsystem is a CPU 78 which may be any well-known microcomputer or microprocessor. CPU 78 communicates with the various components of the electronic subsystem by means of computer bus 80. CPU 78 is operated by a control program stored in memory 82. Memory 82 may be a random access memory (RAM) or any other suitable memory for containing the control program for CPU 78. In addition to memory 82, for containing the control program, a nonvolatile mass storage memory 84 is provided for storing back-up programs and data processed by CPU 78 for later use.

Control commands generated by CPU 78 are processed through input/output (I/0) interface 86, which converts control commands generated by CPU 78 to a form suitable for use by the E/P driver 88 and X-Y drivers 90. Converted control commands to electric-to-pneumatic transducer assembly 36 are generated by E/P driver 88. Converted control commands to motors 48 and 64 are generated by X-Y drivers 90.

The output data from digital camera 66 are sent to vision interface unit 98. Vision interface unit 98 contains two frame buffer circuits 100 and 102, so that the image acquired by digital camera 66 can be collected into one buffer while the previously-collected image in the other buffer is being processed by CPU 78. This allows image information to be processed without gaps or "dead times". Vision interface unit 98 communicates with CPU 78 via computer bus 80. Vision interface unit 98 also contains other video processing circuits to process the video information into a form suitable for display on a television monitor. Processed video from vision interface unit 98 is sent to a television monitor 94 to provide visual feedback to an operator. If desired, the processed video may also be sent to a videocassette recorder 96, where the signal may be recorded for later analysis or for archival purposes.

A joystick control 92 and a keyboard 104 are provided to enable an operator to communicate directly with CPU 78 as desired in order to set up the system and provide manual control. A CRT 106 is also provided to give a visual display of various data and operating parameters, other than processed video, as desired.

As best seen in FIG. 1, all of the electronic components may be housed in a booth 108 or other similar structure, so that the electronic components are isolated from the high temperatures of casting station 16. The electronic subsystem may be connected to the mechanical components of the invention through appropriate cabling run in overhead conduit 110. If desired, booth 108 may be air conditioned to further protect the electronic components from heat and to provide operator comfort.

Operation of the invention will now be described. It will be understood by those skilled in the art that, apart from the broad principles of the invention, the details of operation may be left to those skilled in the art.

Figure 3:
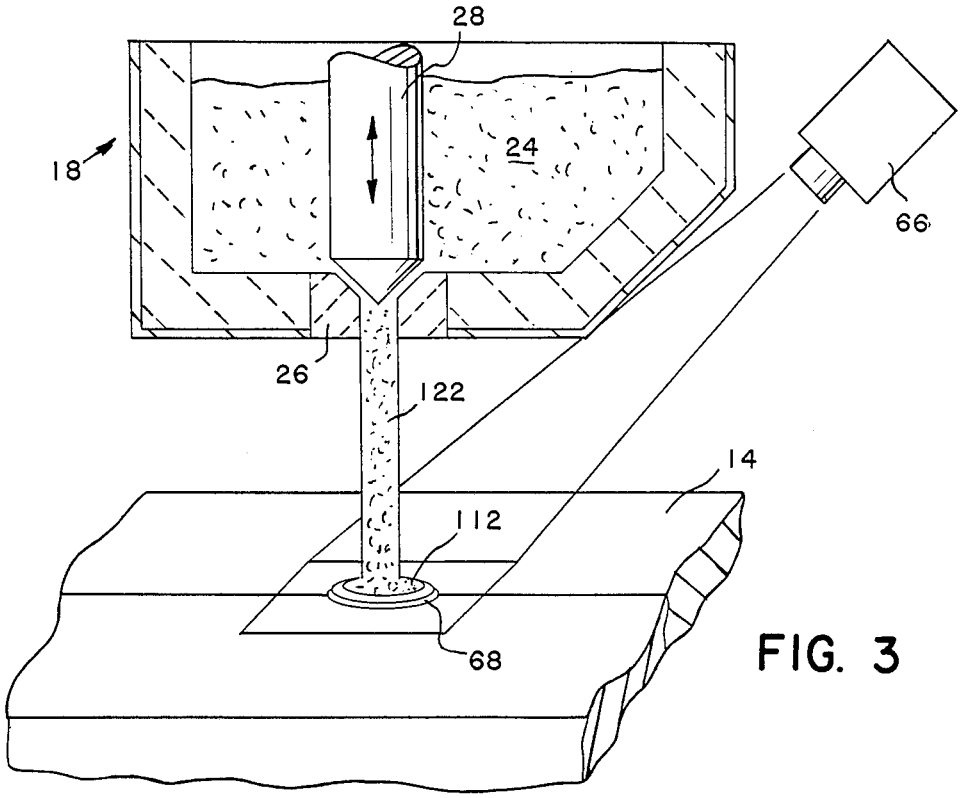
FIGS. 3, 3A, 3B and 3C are simplified diagrammatic representations of certain principles of the invention.
Figure 3B:
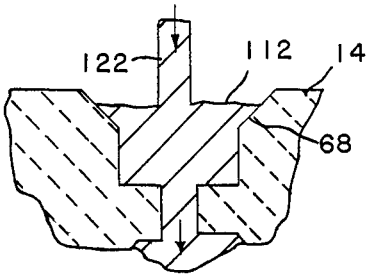
Figure 3C:
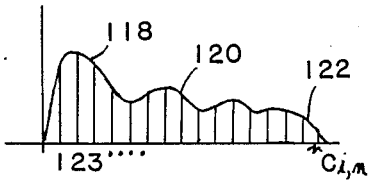
Figure 3A:
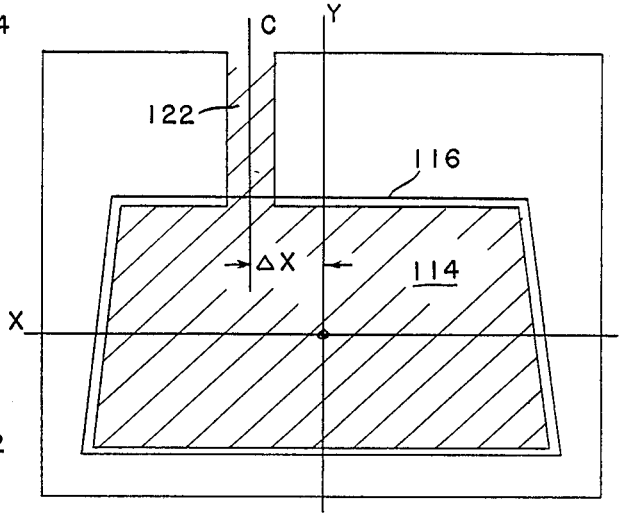

Referring now to FIGS. 3, 3A, 3B and 3C, digital camera 66 is focused on the surface of mold 14 around a sprue cup 68, which may be cone-shaped as shown, or which may be any other suitable shape, and acquires a digital image of the surface 112 of the molten metal in the sprue cup. The image acquired by digital camera 66 is schematically illustrated in FIG. 3A. Reference surface area values, indicated by the larger trapezoid 116 in FIG. 3A, are stored in memory 82. Shaded portion 114 represents the image of actual surface 112 viewed by digital camera 66. This image is sent to vision interface unit 98, and then to CPU 78, one frame at a time. Preferably, a larger number of frames (i.e., a high sampling rate) are acquired when pouring each mold. For example, a typical known digital camera acquires 30 frames per second. The image is processed in CPU 78 and cleared of obstructing artifacts, such as streams, splashes, drops and sparks. The actual surface area of molten metal surface 112 is then computed in CPU 78 from the digital image. The reference area is compared with the most recent digital image acquired by digital camera 66 and a difference value E, representing the difference between the actual surface area and the reference surface area, is computed by CPU 78. A derivative $D=dE/dt$ and integral $I=\cdot E\ dt$ are also computed by CPU 78. At that point, a control value is computed by CPU 78 according to the following formula:

$$C_{i,n}=-G(E_i+K_1D_i+K_2I_i) \quad (1)$$

where:

$C_{i,n}$=control value
i=sample number
n=pour number
G=gain factor
$K_1$=derivative factor
$K_2$=integral factor The control values $C_{i,n}$ are illustrated in FIG. 3C, and are used to drive electric-to-pneumatic transducer assembly 36 which, in turn, controls the position of stopper rod 28, therefore controlling the flow of molten metal into the mold. As seen in FIG. 3C, the control values which occur at the beginning of a pour (designated generally by 118) are higher in amplitude than the control values of "steady state" pour (designated by 120). This indicates that stopper rod 28 is fully open at the beginning of a pour, to quickly flood sprue cup 68 with metal. Once sprue cup 68 is filled, the control values vary during a pour (120) for the duration of the pour, so that flow of metal into the sprue cup 68 is always equal to the flow inside the mold through the mold gating system.

The control values $C_{i,n}$ may be adaptively altered after each pour as a function of previous pours in order to minimize the difference E. This can be done by adding socalled offset bias values $B_{i,n}$ to the control values $C_{i,n}$ according to the following formula:

$$C_{i,n}=-G(E_i+K_1D_i+K_2I_i)+B_{i,n} \quad (2)$$

where $B_{i,n}$ are bias values representative of an offset bias given to the control values.

The offset bias $B_{i,n}$ is computed after each pour as a function of previous pours and the most recent pour, according to the formula:

$$B_{i,n}=f(C_{i,n}, B_{i,n-1}) \quad (3)$$

where f (C, B) is an empirically determined function.

The control bias values $B_{i,n}$ may be set arbitrarily for the first pour and stored in a table in CPU 78. Control values $C_{i,n}$ are stored only for the current pour. For a new pour, while indexing molds 14, control bias values $B_{i,n}$ are updated in CPU 78 based on the control signal values of the current pour and the control bias values of the previous pour. Thus, the system is an adaptive one which takes into account differences from previous pours, and minimizes the difference E in just a few pours.

The control bias values $B_{i,n}$ as set arbitrarily for the first pour are set to accomodate "metal in transit" based on anticipated flow rates for the particular mold being filled. Thus, control bias values $B_{i,n}$ are chosen to gradually "taper" the flow of molten metal to zero at the end of the pour so that the mold will be precisely filled, without over- or under-filling it. Since the bias values for the first pour, $B_{i,1}$, are set arbitrarily, the first mold may in actuality be under- or over-filled. However, the bias values for the second and successive pours, $B_{i,2}$, $B_{i,3}, \ldots, B_{i,n}$, are adaptively updated according to equation (2) above so that the flow at the end of the pour is correctly "tapered" based on previous pours and thus flow can be more precisely controlled to precisely fill the succeeding molds.

In addition to controlling the flow, CPU 78 also generates correction values for the X and Y positioning of metal stream 122 with respect to the axis of sprue cup 68. The center of the sprue cup is computed in CPU 78 from the most recent acquired image from digital camera 66. The center of the pour can be determined when the system is initially adjusted, so that the location of the center of the pour is fixed with respect to camera 66. CPU 78 generates appropriate command values to X-Y drivers 90 to actuate motors 48 and 64 to position reservoir 18 so that the center of pour opening 26 coincides with the axis of sprue cup 68.

Various ways in which CPU 78 may be programmed to carry out the functions and operations described above will be apparent to those skilled in the art. Such programming details are not crucial to the present invention, and the invention is not limited by the particular program chosen.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus for controlling the pour of molten metal into individual molds, comprising:

(a) at least one mold having a sprue to receive molten metal and having a mold gating system internal to the (b) reservoir means for holding molten metal to be poured into the mold, (c) flow control means operatively associated with the reservoir means for controlling the flow of molten metal from the reesrvoir means into the mold, (d) sensor means for continuously sensing the image of the surface of the molten metal in the sprue and generating image area information representative of the surface area of the metal relative to the surface of the mold, (e) sampling means for repetitively sampling the image area information during predetermined sampling intervals for a pour and generating sampled image area information at a preselected sampling rate, (f) means for repetitively comparing the sampled image area information to a preselected reference area value and generating a difference value representative of the difference between the image area information and the reference area value, and (g) control means responsive to the difference value for generating a control signal to the flow control means for controlling the flow of molten metal into the sprue to equal the flow of metal into the mold through the mold gating system and to terminate the flow of metal to accommodate metal in transit from the reservoir means to the mold to precisely fill the mold, the control signal comprising a control value for each sampling interval, each control value being a function of the difference value for its associated sampling interval and control bias values for that sampling interval based on preselected pour parameters from at least one previous pour.

2. Apparatus according to claim 1, wherein the sensor means comprises a video camera.

3. Apparatus according to claim 1, wherein the sensor means comprises a digital electronic camera.

4. Apparatus according to claim 1, wherein the control means comprises a microprocessor.

5. Apparatus according to claim 1, wherein the reservoir means comprises a bottom-pour ladle.

6. Apparatus according to claim 5, wherein the flow control means comprises a stopper rod.

7. Apparatus according to claim 1, further comprising positioning means for centering the flow of molten metal with respect to the mold sprue.

8. Apparatus for adaptively controlling the pour of molten metal into individual molds, comprising:

(a) sensor means for sensing a parameter representative of a pour characteristic and generating information representative of the sensed parameter, (b) means for comparing the information to a preselected reference parameter value and generating a difference value representative of the difference between the information and the reference parameter value, (c) means for generating pour control values over the duration of a pour based on the difference value and control bias values derived from parameter information from previous pours for adaptively altering the control values for successive pours, and (d) control means responsive to the pour control values for adaptively controlling successive pours.

9. Apparatus according to claim 8, wherein the sensor means comprises a video camera.

10. Apparatus according to claim 8, wherein the sensor means comprises a digital electronic camera.

11. Apparatus according to claim 8, wherein the control means comprises a microprocessor.

12. Apparatus for controlling the pour of molten metal into individual molds, comprising:

(a) at least one mold having a sprue to receive molten metal and having a mold gating system internal to the mold, (b) reservoir means for holding molten metal to be poured into the mold, (c) flow control means operatively associated with the reservoir means for controlling the flow of molten metal from the reservoir means to the mold, (d) sensor means for continuously sensing the image of the surface of the molten metal in the sprue and generating image area information representative of the surface area of the metal relative to the surface of the mold, (e) sampling means for repetitively sampling the image area information during predetermined sampling intervals for a pour and generating sampled image area information at a preselected sampling rate, (f) means for repetitively comparing the sampled image area information to a preselected reference area value and generating a difference value representative of the difference between the sampled image area information and the reference area value, (g) control means responsive to the difference value for generating a control signal to the flow control means for controlling the flow of molten metal into the sprue to equal the flow of metal into the mold through the mold gating system and to terminate the flow of metal to accommodate metal in transit from the reservoir means to the mold to precisely fill the mold, the control signal comprising a control value for each sampling interval, each control value being a function of the difference value for its associated sampling interval and control bias values for that sampling interval empirically determined from pour parameters of previous pours, and (h) positioning means for centering the flow of molten metal with respect to the mold sprue.

13. Apparatus according to claim 12, wherein the sensor means comprises a digital electronic camera.

14. Apparatus according to claim 12, wherein the control means comprises a microprocessor.

15. Apparatus according to claim 12, wherein the reservoir means comprises a bottom-pour ladle and the flow control means comprises a stopper rod therein.

16. Apparatus according to claim 12, wherein the positioning means comprises means for moving the reservoir means in mutually orthogonal axes in a horizontal plane.

17. Apparatus for controlling the pour of molten metal into individual molds, each mold having a sprue to receive molten metal and having a mold gating system internal to the mold, comprising:

(a) a bottom pour ladle for holding molten metal to be poured into the molds, (b) a stopper rod in the bottom-pour ladle for controlling the flow of molten metal from the bottom pour ladle into the molds, (c) a digital electronic camera for sensing the image of the surface of the molten metal in the sprue and generating a sequence of individual frame signals representative of the surface area of the metal relative to the surface of the mold, (d) microprocessor means for repetitively comparing each frame signal to a preselected reference and generating a difference value representative of the difference between each frame signal and the reference, (e) the microprocessor means being arranged to generate a control signal to the stopper rod for controlling the flow of molten metal into the sprue to equal the flow of metal into the mold through the mold gating system and to terminate the flow of metal to accommodate metal in transit from the ladle to the mold to precisely fill the mold, the control signal comprising a unique control value for each frame signal, each control value being a function of the difference value for its associated frame signal and control bias values for that frame signal based on preselected pour parameters from previous pours, and (f) positioning means for centering the flow of molten metal with respect to the mold sprue.

18. Method of adaptively controlling the pour of molten metal into individual molds, comprising the steps of:

(a) sensing a parameter representative of a pour characteristic and generating information representative of the sensed parameter, (b) comparing the information to a preselected reference parameter value and generating a difference value representative of the difference between the information and the reference parameter value, (c) generating pour control values responsive to the difference value, (d) generating control bias values over the duration of a pour based on parameter information from previous pours, and (e) adaptively altering the control values by the control bias values for successive pours.

19. Method of adaptively controlling the pour of molten metal into successive molds, comprising the steps of:

(a) sensing a parameter representative of a pour characteristic and generating information representative of the sensed parameter, (b) comparing the information to a preselected reference parameter value and generating a difference value representative of the difference between the information and the reference parameter value, (c) computing at least one pour control value as a function of the difference value, (d) determining at least one bias value as a function of the most recent previous pour and all previous pours, (e) updating the at least one pour control value by the at least one bias value for the next succeeding pour, and (f) controlling the next succeeding pour as a function of the updated control value.

20. Method according to claim 19, wherein the at least one pour control value is computed by summing the difference value, a scaled derivative of the difference value and a scaled integral of the difference value and then scaling said sum.

21. Method according to claim 20, wherein the scale values are emperically determined.

22. Method according to claim 21, wherein the at least one pour control value is updated by adding thereto the at least one bias value.

* * * * *